US006122845A

United States Patent [19]

Menghi

[11] Patent Number: 6,122,845

[45] Date of Patent: Sep. 26, 2000

[54] PLASTIC MOULDED MONOLITHIC BEACH SANDAL

[75] Inventor: Emanuela Menghi, Macerata, Italy

[73] Assignee: Menghi Shoes S.R.L., Italy

[21] Appl. No.: 09/450,583

[22] Filed: Nov. 30, 1999

[51] Int. Cl.[7] ..... A43C 11/16

[52] U.S. Cl. ..... 36/50.1; 36/11.5; 36/114; 36/24

[58] Field of Search ..... 36/11.5, 50.1, 36/114, 24

[56] References Cited

U.S. PATENT DOCUMENTS

| | | | |
|---|---|---|---|
| 125,400 | 4/1872 | Lawson | 36/50.1 |
| 2,015,479 | 3/1935 | Koomruian | 36/11.5 |
| 2,491,297 | 12/1949 | Brown | 36/50.1 |
| 2,760,279 | 8/1956 | Jones et al. | 36/11.5 |
| 3,263,292 | 8/1966 | Fekete | 36/11.5 |
| 3,722,113 | 3/1973 | Birkenstock | 36/11.5 |
| 4,535,554 | 8/1985 | De Obaldia D | 36/113 |
| 4,592,152 | 6/1986 | Wright et al. | 36/11.5 |
| 4,670,998 | 6/1987 | Pasternak | 36/50.1 |

FOREIGN PATENT DOCUMENTS

| | | | |
|---|---|---|---|
| 246974 | 11/1947 | Switzerland | 36/50.1 |

*Primary Examiner*—Paul T. Sewell
*Assistant Examiner*—Troy Arnold
*Attorney, Agent, or Firm*—Leonard Bloom

[57] ABSTRACT

The present invention relates to a plastic moulded monolithic sandal using an upper that comprises a continuous base band, with no holes or incisions, directly fixed to the sole, as well as one or more transversal closing straps, each of them composed of two separate ends capable of overlapping and closing.

1 Claim, 1 Drawing Sheet

PLASTIC MOULDED MONOLITHIC BEACH SANDAL

The present patent application for utility model relates to a completely moulded plastic beach sandal.

As it is known, economic models of plastic moulded beach sandals with monolithic structure have been available on the market for some time. These sandals feature a special upper made up of a series of strips that are crossed and laterally joined to the edges of the sole. The upper is an open upper (or semi-upper), that features a strap in the back to embrace the heel of the user.

Although very popular, traditional beach sandals have however shown some functional disadvantages. The first one is due to the special structure of the upper they use.

Being composed of various crossed strips, the upper features a series of wide slots on the entire perimeter of its lower edge, that is the edge which is directly applied to the perimeter of the front half plant of the sole.

While the said slots ensure foot transpiration, at the same time they allow for the easy penetration of sand, dust, pebbles and water, that may cause great discomfort for the user while when walking or when putting the sandal on. It must be said that the strap located in the back of the open upper features a buckle provided with metal tongue which is often subjected to rust or sudden wear, in view of the use of the beach sandals.

According to the current technology, the assembly of the buckles on a traditional sandal of the mentioned type takes place during a specific separate operating stage, that can only be carried out once the complete sandal has been moulded, with a considerable amount of time and labor.

The purpose of the present invention is to realise a plastic moulded beach sandal with monolithic structure capable of eliminating the disadvantages of the current technique, while maintaining the practical and economical characteristics of the traditional items.

First of all, it must be said that the sandal according to the present invention features a special closed upper, basically made up of a perimeter band with limited height—capable of embracing the foot on the top, the sides and the heel—and of two transversal straps.

The perimeter, band is designed to embrace the foot of the user and is directly joined to the perimeter edge of the sole, without featuring openings or incisions in the joining section. This fact prevents the penetration of sand, pebbles, water, etc.

Nevertheless, the sandal according to the present invention is capable of ensuring effective foot transpiration, since the upper is closed by means of two transversal thin straps, the first one located approximately where the toes begin, and the second one approximately at the height of the foot neck. Each strap is composed of two separate ends—an upper and a lower end—that can be permanently joined by means of special innovative closing means integrally obtained during the same production stage with the same material used to mould the sandal, thus eliminating the need for independent closing means with metal structure.

Once the straps have been open by separating the two ends, the sandal can be easily worn by simply introducing the foot inside it, from above downwards.

This avoids the typical, uncomfortable translatory movement of the foot, from the back towards the front, which is necessary to introduce the foot under the half closed upper of the models of beach sandal currently available on the market.

As a matter of fact, introducing the foot with in the traditional beach sandals is not always an easy or comfortable operation, especially when the feet are wet or sweat, or when the front half of the upper is immersed in water.

For major clarity the description of the invention according to the present invention continues with reference to the enclosed drawing, which is intended for purposes of illustration and not in a limiting sense, whereby:

Figure 1:
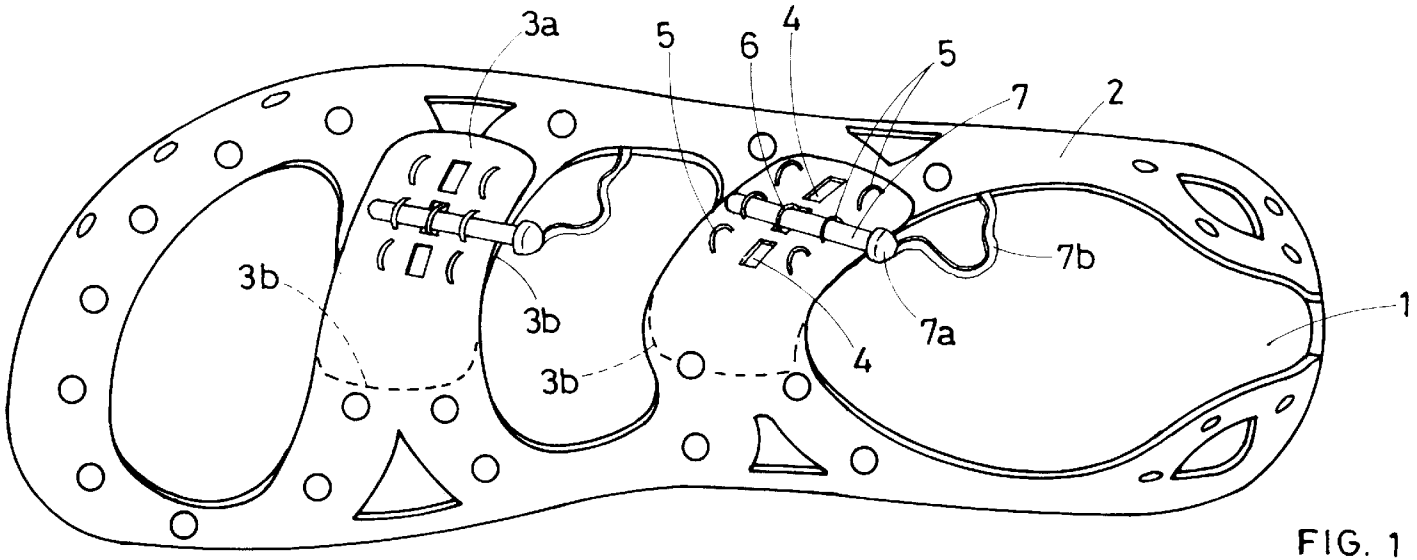
FIG. 1 is a top view of the beach sandal according to the present invention.
Figure 2:
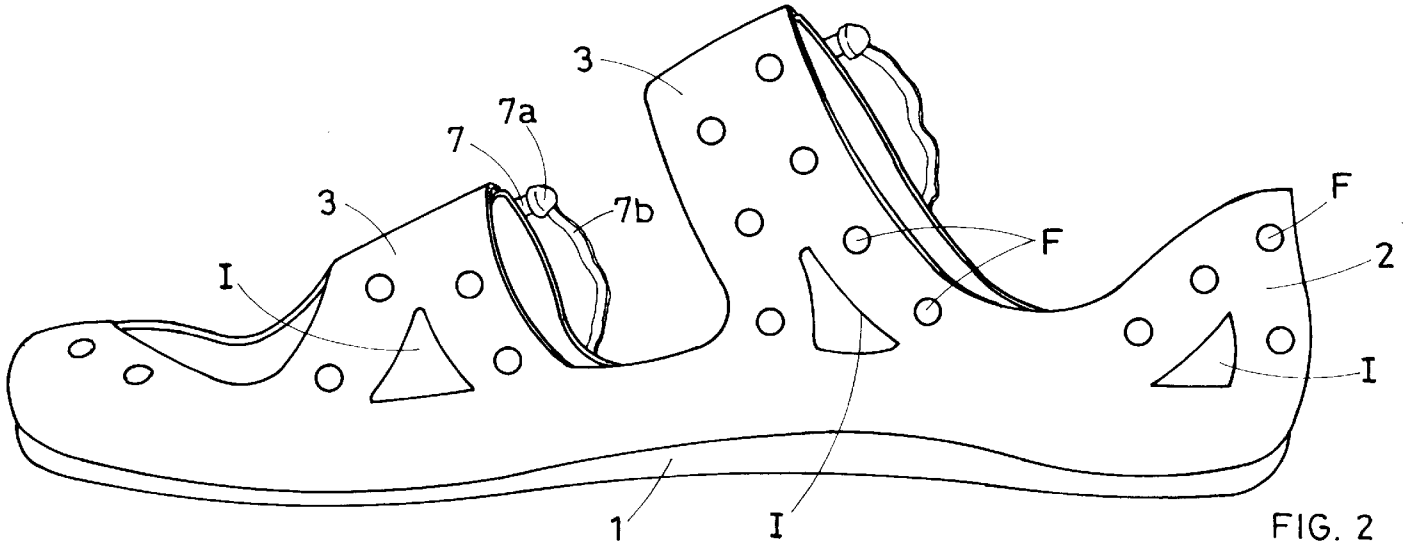
FIG. 2 is a view from the internal side of FIG. 1.

With reference to the above figures, the monolithic sandal according to the present invention comprises a sole (1), perimetrally fixed to an upper (2) with reduced height, provided with two transversal closing straps (3) in the upper part.

More precisely, the upper (2) is joined to the sole (1) on a perimeter base band of the upper (2) featuring a continuous surface with no openings. Small holes (F) or incisions (I) for transpiration purposes are located above the perimeter base band, at a height that does not allow for the penetration of sand or pebbles inside the sandal.

Each strap (3) is composed of two separate ends (3*a* and 3*b*)—an upper (3*a*) and a lower (3*b*) end—capable of overlapping and closing. In order to mutually block the ends (3*a* and 3*b*) of each transversal strap (3), the upper end (3*a*) features a series of slots (4) on its central longitudinal axis. The series of slots (4) is located between two series of bridges (5) with the same orientation.

The lower end (3*b*) features instead a single central bridge (6) in parallel direction with respect to the bridges (5) of the upper end (3*a*). In order to mutually block the two ends (3*a* and 3*b*) of each strap (3), the 25 bridge (6) of the lower end (3*b*) is inserted in one of the slots (4) of the upper end (3*a*), so that the bridge (6) protrudes from the top face of the upper end (3*a*).

In this condition, the bridge (6) is aligned with and located between two bridges (5)—one upwards and one downwards—of the upper end (3*a*). Now, a special blocking pin (7) with enlarged head (7*a*) and longer than the axis between the two parallel series of bridges (5) on the upper end (3*a*) must be used.

In this way, the pin (7) is capable of simultaneously crossing three bridges aligned in transversal direction with respect to the strap (3), namely the two bridges (5) of the upper end (3*a*) and the bridge (6) of the lower end (3*b*) located in intermediate position between the bridges (5), as shown in FIG. 1. In particular, the pin (7) must be inserted from the back towards the front of the sandal, thus preventing the downwards exit of the bridge (6) of the lower end (3*b*) from the slot (4) located in the upper end (3*a*), causing the accidental uncoupling of the ends and the opening of the upper.

To this end, it must be noted that the pin (7) is permanently joined to the upper (2) by means of a flexible tongue (7*b*). As a matter of fact, the pin (7) and the tongue (7*b*) are made of the same material and during the same moulding stage as the entire sandal.

This means that in the sandal according to the present invention the closing means of the upper are incorporated into the moulding stage, thus resulting extremely practical, economic and effective. In this way it appears obvious that such closing means do not require additional operations for their assembly, unlike the metal buckles that are currently used on traditional sandals.

It is worth noting that the bridge (6) of the lower end (3*b*) can be inserted in any of the slots (4) of the upper end (3*a*). The user will be free of choosing the most appropriate slot (4) according to the size of the foot and to his personal preference for looser or tighter straps (3).

What is claimed is:

1. Plastic moulded monolithic sandal, characterised in that it features a special upper (2) that comprises a continuous base band directly fixed to the sole (1) as well as one or more transversal closing straps (3), each of them composed of two separate ends (3*a* and 3*b*) capable of closing, with the upper end (3*a*) featuring a series of slots (4) on its central longitudinal axis located between two series of bridges (5) with the same direction, and with the lower end (3*b*) featuring a single central bridge (6) with the same location as the bridges (5), suitable for being introduced from down upwards in any slot (4) of the upper end (3*a*); it being provided that each strap (3) is joined by means of a flexible tongue (7*b*) to a pin (7) with enlarged head (7*a*) capable of being inserted in the bridges (5 and 6) and longer than the axis located between the two parallel series of bridges (5) on the upper end (3*a*) of the strap (3).

* * * * *